United States Patent [19]

Kurematsu et al.

[11] Patent Number: 5,023,644

[45] Date of Patent: Jun. 11, 1991

[54] SMALL-SIZED AUTOMATIC DEVELOPER OF PHOTOGRAPHIC MATERIAL

[75] Inventors: Masayuki Kurematsu; Shigeharu Koboshi; Nobutaka Goto, all of Hino, Japan

[73] Assignee: Konica Corporation, Tokyo, Japan

[21] Appl. No.: 435,071

[22] Filed: Nov. 13, 1989

[30] Foreign Application Priority Data

Nov. 16, 1988 [JP] Japan ..... 63-290980

[51] Int. Cl.[5] ..... G03D 3/04; G03D 3/08

[52] U.S. Cl. ..... 354/320; 354/328

[58] Field of Search ..... 354/316, 320, 321, 322, 354/328

[56] References Cited

U.S. PATENT DOCUMENTS

| | | | |
|---|---|---|---|
| 3,760,705 | 9/1973 | Miller | 354/322 |
| 4,252,429 | 2/1981 | Hope et al. | 354/322 |
| 4,255,039 | 3/1981 | Hope et al. | 354/320 |
| 4,755,843 | 7/1988 | Foley | 354/299 |

FOREIGN PATENT DOCUMENTS

| | | |
|---|---|---|
| 62-183461 | 8/1987 | Japan . |
| 62-183462 | 8/1987 | Japan . |

*Primary Examiner*—A. A. Mathews

*Attorney, Agent, or Firm*—Jordan B. Bierman

[57] ABSTRACT

The invention provides an apparatus for developing a photographic material having an emulsion surface thereon. The apparatus includes a processing tank for storing processing solution therein; a conveying rack, disposed in said processing tank, for conveying a photographic material downwardly so that a photographic material is introduced in the processing solution and for conveying a photogrpahic material upwardly so that a photographic material is delivered from the processing solution, wherein an emulsion surface of a photographic material being conveyed downwardly is arranged to face an emulsion surface of a photographic material being conveyed upwardly; and an agitator, disposed between the downwardly conveyed photographic material and the upwardly conveyed photographic material, for agitating the processing solution.

22 Claims, 7 Drawing Sheets

SMALL-SIZED AUTOMATIC DEVELOPER OF PHOTOGRAPHIC MATERIAL

BACKGROUND OF THE INVENTION

The present invention relates to an automatic developer used for processing of silver halide photographic material, such as color film, and also relates to a small-sized, simple automatic developer, which is most suitable, for example, to the so-called news reporting, where it is carried to the photographing site, the photographed news reporting film is processed, and the image of such film is promptly sent to the newspaper head office, etc. by telephotography, or to the use as a hobby in the home.

Further, more particularly, it relates to a small-sized automatic developer, in which installation of circulation pump, etc. for agitating the processing liquid is not intended.

With respect to news reporting photographs where speediness is required, the undeveloped film itself is promptly sent from the site to the head office, etc. and is processed there, in case the photographing site is relatively close to the newspaper head office or branch office, etc.

However, in case the photographing site is at a distant location, the photographed film is developed and its image is sent by telephotography, as a common practice.

In developing such photographic film for news reporting, it is possible to use a developing service facilities, such as the so-called mini laboratory nearby. However, such facilities may not always accept urgent request for processing, and no services are available there at night. Therefore, it is common that developing is done by manual work, such as the so-called manual developing or disk developing.

Alternately, some use an automatic developer, which is on the market for news reporting, or a small-sized developer of manual developing type for hobby.

Up to this time, in the automatic film developer of the so-called cinema type, techniques of circulating the processing liquid in the tank by use of a circulating pump or spraying the processing liquid onto emulsion surface of the film are employed, so as to make the processor temperature uniform or to improve the processing performance by realizing a good mixing quality with the replenishing liquid.

For example, in the conventional automatic developers, jet agitation (E-Jet Agitation), opposed roller agitation, etc., as employed in Fuji Minilabo Champion 23S, are known. Further, jet agitation by jet type branching pipe and rotating roller agitation, as stated in specifications of Patent Disclosure (Japanese Patent O.P.I Publication) No. 183461/1987 and Patent Disclosure No. 183462/1987, are known. However, most of them were the type which were installed on the tank wall of the automatic developer.

Conventional automatic developers for news reporting available on the market are of relatively large size, requiring an automobile, etc. of truck or ban type, which are inconvenient for carrying to photographing site, yet there are still many parts which require manual operation, and long processing time is required. Because of the above reasons, they are far from popular use. Further, small-sized developers for hobby are almost all manually operated, requiring processing skills, equivalent to those in manual developing, using the so-called disk developing method. Therefore, they are not yet used.

Such being the situation, among people in news reporting there have been wishes of having a small-sized, simple automatic developer which meets the following requirements:

(1) Small-sized, light weight and convenient for carrying, and desirably to be portable with one person, without use of a car, etc.

(2) Film conveying, processing liquid handling, processing temperature adjusting, drying and other processes are carried out under automatic control, thereby not requiring skilled techniques in operation.

(3) Good and stable processing performance (4) Short processing time (5) Little malfunction, and little maintenance expenses.

The present invention has been completed as part of the studies concerning a small-sized automatic developer most suitable for news reporting or for hobby, in meeting the above requirements. Specially, a subject of the invention is to clarify the technical construction which will meet both the requirements for small-size and light weight and the requirements for preventing the lowering of processing performance due to uneven temperature and uneven liquid, in keeping a good balance between them.

That is to say, in the conventional, the so-called cinema type automatic film developer of liquid circulation or jetting type, motor, pump, piping, nozzle, etc. are required. Specially, the driving source and driving transmitting mechanism of film conveying system and the pump driving system for liquid circulation and jetting are separated, regardless of the belt system or the roller system, thereby constituting a large negative factor with respect to the requirements for small size and light weight.

The principal object of the present invention is disclosed a small-sized, automatic developer for news reporting or for hobby, which has solved the above problems, and other object of or benefit from the present invention will become clear from the statement hereinafter or drawings attached.

SUMMARY OF THE INVENTION

Characteristics of an automatic developer of the present invention, which solves the above problems, are as follows:

(1) The film is conveyed along the conveying rack installed in the processing tank, where the emulsion surface of the film will mutually face inward, and at the same time such conveying rack has means for working the agitation member along the conveying direction, on the inner side of the emulsion surface by the power of conveying driving force of the conveying rack.

(2) The agitation member agitates the processing liquid by reciprocating motion in vertical direction.

(3) This agitation member agitates the processing liquid by rotating motion.

(4) The agitation member is driven by a small-sized power source different from the power source for conveying photographic material in the conveying rack.

(5) In the vertical reciprocating motion, the processing liquid agitation means is characterized by having different motion speeds of the agitation member, depending on upward or downward direction.

(6) Motion speed of the agitation member in downward direction is made larger than that in upward direction.

(7) Motion speed of the agitation member in upward direction is made larger than that in downward direction.

(8) The distance between the vane or blade in agitation member and the film surface is to be set at 50 mm or less.

(9) Vertical motion of the agitation member is carried out at least once 20 seconds.

(10) The form of the vane in agitation member is to be fabricated in circular arc, so that the center of the vane is farther than the tip thereof from the surface of the film.

(11) In the conveying rack beyond the upper stopping point or top dead center and the lower stopping point or bottom dead center of the agitation member, which makes a vertical motion, there is to be attached a conveying route regulating member for preventing meandering of the photographic material.

(12) In the conveying rack there is to be attached a contact preventing member, so as to prevent mutual contacting of the photographic material, which move in vertical direction.

(13) In order to stabilize the developing performance, while reducing the equipment weight, a circulation pump for the processing liquid is to be provided only for the color developing tank, thereby making temperature and concentration uniform.

(14) In order to stabilize the developing performance, a temperature sensor for temperature adjustment is to be installed in the color developing tank and the fixing tank or in the color developing tank and the bleaching fixing tank, etc.

Next, the agitation member used in the present invention will be explained.

The agitation member can be of any material, such as rubber, soft vinyl chloride resin, hard vinyl chloride resin, etc., which do not have any effect on photographic performance, or which have corrosion resistance against the processing liquid.

Such agitation member may come into contact with surface of the photographic material. However, from standpoint of eliminating possible generation of scars on photographic material, it is employed in such a manner that no contact is made. While the distance between such agitation member and photographic material is desirably within a range of 0.5 to 10 mm from the standpoint of agitation efficiency, adequate degree of agitation can be obtained as long as the distance is less than 50 mm. Further, such agitation member is made to move around a portion close to the surface of photographic material, in the same direction or in reverse direction with respect to the conveying direction of photographic material.

Further, it is also possible to fit a soft material, such as rubber, etc. at the tip of those agitation members, so as to prevent scars on the photographic material. Further, one of the preferred embodiments in the form of the vane in agitation member is that its center is fabricated in circular arc, so as to be farther away from the photographic material than its tip. Furthermore, when the processing tank capacity is large, it is relatively easy to install each type of agitation means in the tank of automatic developer. However, with respect to tanks of 3 l or less in capacity, it is physically difficult to use those regular agitation means. Therefore, application of the present invention will bring about significant effects. Particularly, effects are produced when the capacity is 2.5 l or less, and significant effects are further produced when the capacity is 2.0 l or less.

Further, in the case of rapid processing, where the total processing period of photographic material is within 10 minutes, effects of agitation on photographic performance are extremely large, thereby making the agitation means of the present invention quite meaningful and bringing about the above effects of the present invention significantly. In the case of rapid processing of within 8 minutes, its effects will become more significant.

Furthermore, the silver halide photographic material used in the present invention can make use of any photographic material, such as for black and white (for X-ray film, for lith film, black/white film, black/white paper, etc.) and for color (for color negative film, for color negative paper, for color reversal film, for color reversal paper, etc.), etc. However, when the silver halide color photographic material, which poses problems in the developing characteristics of 3 layers of B. G. R. particularly, is used in the automatic developer of the present invention, its effects will become significant. The reasons are as follows. In the case of black and white photograph, the gradation will be determined by one silver image, thereby hardly generating problems on photographic performance comparatively. However, in the case of color photograph, the balance in 3 layers of B. G. R. will pose problems, thereby requiring effective agitation.

The present invention is specially applicable favorably to the photographic materials for photographing, which cannot be done over again, among various color photographic materials.

Next, the present invention having the above characteristics will be explained as a concrete automatic developer.

DETAILED DESCRIPTION OF THE INVENTION

Figure 1:
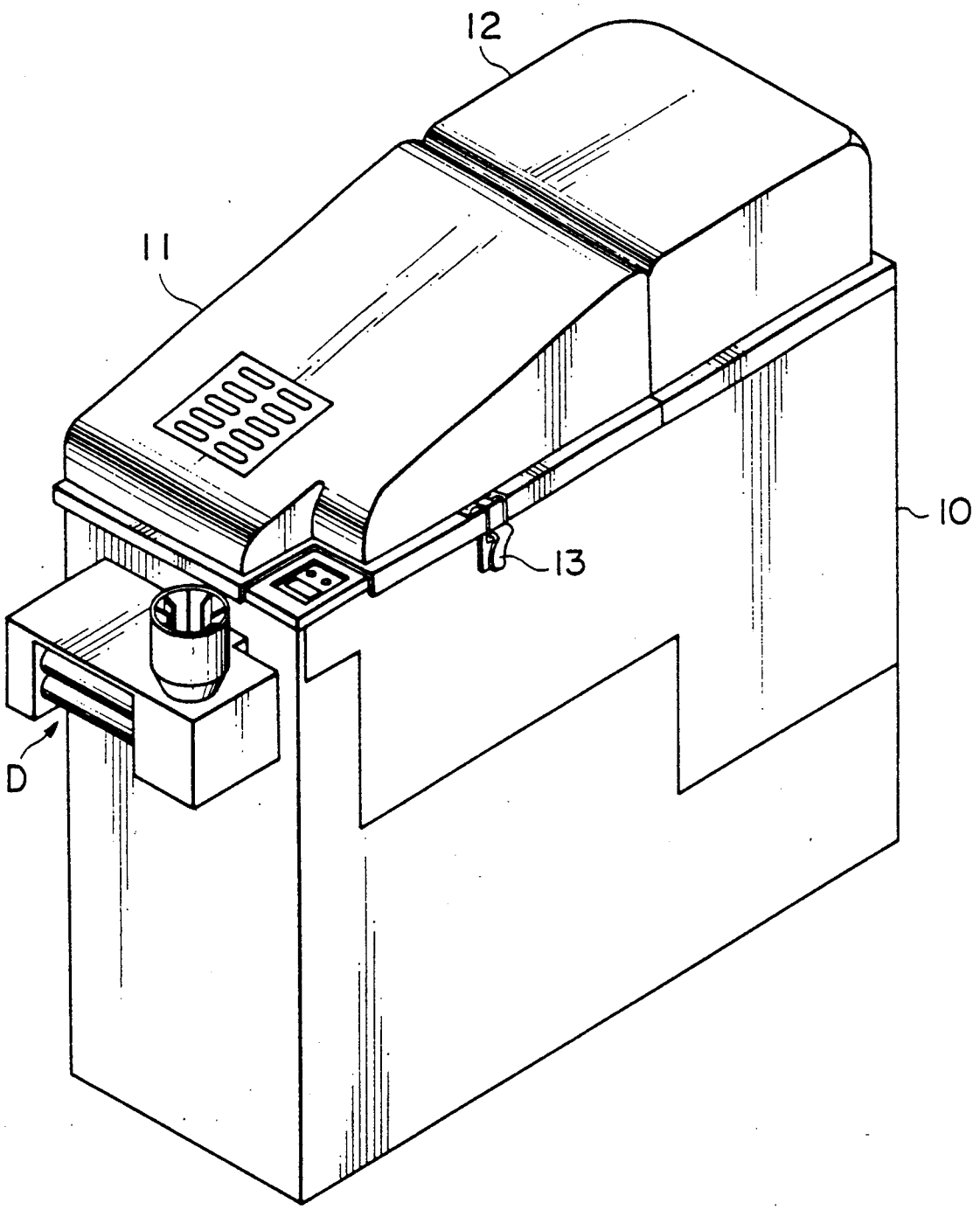
FIG. 1 shows a perspective view of the automatic developer to which the present invention has been applied, FIG. 2 an exploded perspective of the same, FIG. 3 a perspective view of two sizes of conveying racks, FIG. 4 a schematic vertical section of the same, FIG. 5 and FIG. 6 a schematic view of the conveying route regulating member, FIG. 7, FIG. 8 and FIG. 9 a schematic view of the contact preventing member.
Figure 2:
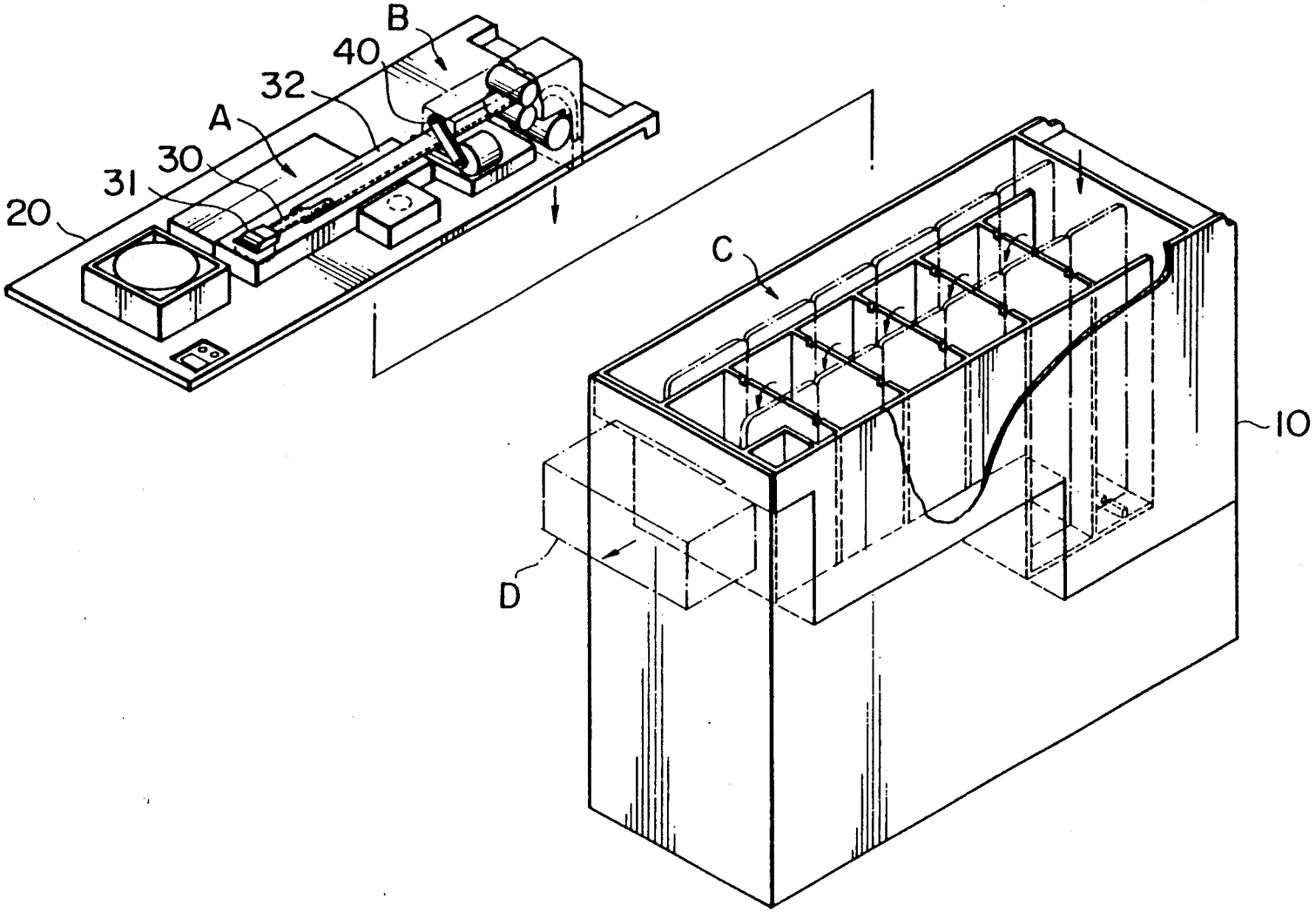

FIG. 1 and FIG. 2 show an automatic developer to which the present invention has been applied. Although not shown in diagrams, on the outer frame of this apparatus there is provided a shoulder strap or handle, etc. for carrying.

In the diagrams symbol 10 indicates the main body frame for storing the processing tank etc. to be described later. The top of this main body frame 10 is maintained in a light shielding condition by covers 11 and 12 as well as the middle cover placed at the top of the main body frame 10, which are not illustrated in FIG. 1 and FIG. 2.

Main body frame 10 and covers 11 and 12 are formed of synthetic resin material or light metal material, so as to plan weight reduction. Further, in the automatic developer illustrated here, for planning further weight reduction, the main body frame 10 itself forms the processing tank frames, thereby forming the main body frame 10 with synthetic resin material having chemical resistance.

Cover 11 is for sealing the film setter A to be described later, and cover 12 is for sealing the film cutting and film receiver B.

Further, covers 11 and 12 may be constructed as a single cover.

Cover 11 is attached to the base plate, on which the film setter A is placed, with a hinge mechanism at its base, and it can be opened upward at a certain degree. In order to be maintained in the closed condition, it is fixed to the upper end of the main body frame 10 with the tightening means 13.

As shown in FIG. 2, the film 30 to be processed is set into the film setter A prepared in the middle cover 20, while being stored in the patrone 31 as it is.

Normally, the film 30 which had been photographed will have a certain length of its tip remaining outside the drawing outlet of the patrone 31. Therefore, after its tip is attached to the film leader 32, it is set into the film setter A.

At this time, film leader 32 is somewhat pushed, so that its tip will engage with the drawing roller of the film drawer B to be described later.

After setting of the film 30 has been completed and the interior is made into a shaded condition by closing the cover 11, when the starting switch not illustrated in the diagram is pressed, the film leader 32 will be drawn into the film drawer B of the film conveying system.

When a certain amount of film 30 is drawn in and the end of film 30 is detected (for example, detection of tensile strength), the cutter 40 will act to cut the place close to the end of film 30, thereby separating film 30 from patrone 31 completely.

Cutter 40 consists of the movable blade on the upper side and the fixed blade on the lower side, and is so constructed to actuate the movable blade, which is rotatable centering around the base end, by the driving force of a motor, or solenoid etc. However, cutters of other type or form may be used.

The film 30 drawn into the conveying system from the film drawer B is further drawn by the film leader 32, which engages with pinion, etc. in the conveying system, and undergoes the developing process, which being conveyed in the processor C, along the conveying route shown in FIG. 2, and is dried automatically being introduced into the dryer D, which is installed in the exterior of the main body frame 10.

Further, such a mode of carrying out the film drying by the so-called hanger drying, for example, is included in the present invention, where the dryer D for drying of film 30 discharged from the processor C is not provided, the installation place of the dryer D is simply made the film outlet, the member 14 is arranged for receiving the undried film 30, and drying of film 30 is made by hanger drying.

Base plate (the middle cover) 20, on which the film setter A and the film drawer B are installed, is attached to the top of the main body frame 10. When this base plate is opened as shown in FIG. 2, the top of the processor C is made open. The fact that the whole base plate 20 can be of a construction which is detachable from the main body frame 10 means that it is of the same construction as that of the covers 11 and 12 which were described previously.

Film 30 is introduced into the processor C, firstly into the color developing tank side, in a condition of having the emulsion surface facing upward, and is conveyed in the processing tank in a condition of having the emulsion surfaces of the film in downward path and in upward path face each other (facing inward).

Agitation member 53 for the processing liquid, which is provided in the conveying rack 50, is moved in vertical direction, via a mechanism for converting the driving force (rotating motion) transmitted from the power of the driving force, which rotates the conveying roller of the conveying rack, into a straight, reciprocating motion. At this time, a difference is provided between the upward motion speed and the downward motion speed of the agitation member 53.

Additionally, the power transmitted from the power of the driving force, which rotates the conveying roller, is used as the rotating force as it is, and the processing liquid on the emulsion surface is agitated by providing the agitation member, which rotates in the conveying rack.

Figure 3:
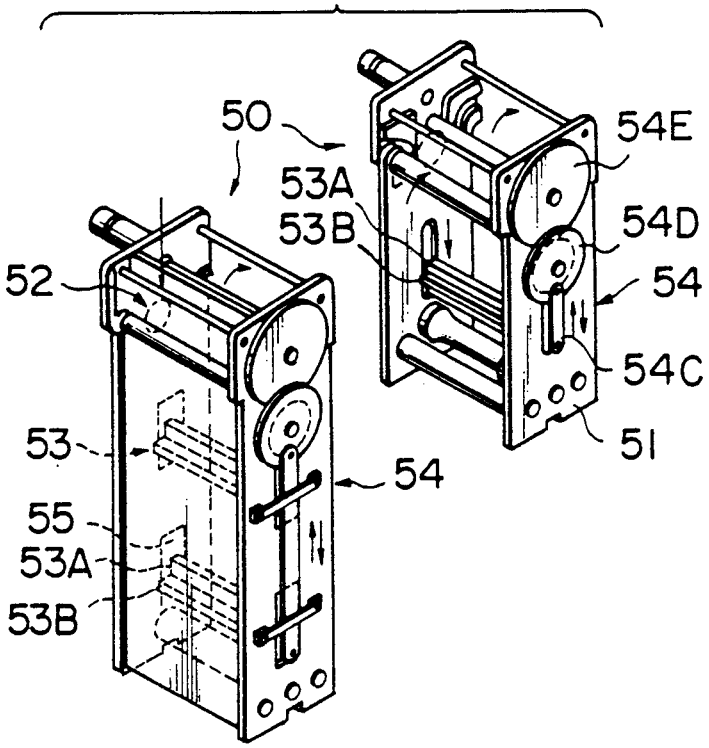

In the mechanism of the mode shown in FIG. 3, the base end of the link 54C is fixed at the eccentric position of the driven gear 54D, and the rotational motion of driven gear 54D is converted into a straight reciprocating motion, thereby transmitting such motion to the agitation member. At the same time, the upward motion corresponds with the rotational motion of gears 54D, 54E, and when the fixed point at the base end of the link 54C exceeds the highest point or the top dead center thereof, it falls freely at a speed higher than the upward motion.

Next, the concrete construction of the processor C applicable to the automatic developer of the present invention will be explained. However, the concrete construction of processing tank and conveying system, processing liquid composition, setting of processing liquid temperature and time, etc. in the processor C are not necessarily restricted to what are explained hereinafter, but there are numerous variations with objects of improving processing performance and reducing processing period and also related to processing liquid composition. Selection among such items does not constitute absolute restrictive factors as the automatic developer which can apply the present invention.

One example of the processing liquid composition, processing tank construction, processing period and processing temperature used in the automatic developer of the present invention is as follows:

I. Example of Processing Liquid Composition

| (1) Color Developing Liquid (CD) | |
|---|---|
| Potassium carbonate | 30 g |
| Sodium hydrogencarbonate | 2.5 g |
| Potassium sulfite | 5.0 g |
| Soldium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxylethyl) | 4.8 g |
| Diethylene triamine penta acetic acid | 3.0 g |
| Potassium hydroxide | 1.2 g |

Water is added to the above to obtain a volume of 1 l, and potassium hydroxide or 20% sulfuric acid is used to adjust it to pH10.06.

| (2) Bleaching Liquid (BL) | |
|---|---|
| 1.3-propylene diamine tetra acetic acid ferric ammonium salt | 0.3 mol |
| Ethylenediamine-tetraccetic acid 2 sodium | 10 g |
| Ammonium bromide | 150 g |
| Glacial acetic acid | 50 g |

Water is added to the above to obtain a volume of 1 l, and aqueous ammonia or glacial acetic acid is used to adjust it to pH4.4.

| (3) Fixing Liquid (Fix) | |
|---|---|
| Ammonium thiosulfate | 200 g |
| Ammonium thiocyanate | 150 g |
| Sodium bisulfite anhydride | 12 g |
| Sodium bisulfite | 2.5 g |
| Ethylene diamine-tetraacetic acid 2 sodium | 1.0 g |
| Sodium carbonate | 10 g |
| Thiourea | 10 g |

Water is added to the above to obtain a volume of 1 l, and acetic acid and aqueous ammonia are used to adjust it to pH7.0.

| (4) Stabilizing Liquid (ST) | |
|---|---|
| Formaldehyde (37% solution) | 2 ml |
| 5-chloro-2-methyl-4-isothiazolin-3- | 0.05 g |
| Emulgen 810 | 1 ml |

Water is added to the above to obtain a volume of 1 l, and aqueous ammonia and 50% sulfuric acid are used to adjust it to pH7.0.

II. Example of Processor (Tank)

| | |
|---|---|
| (1) Color developing (CD) | Parallel installation of 2 racks |
| (2) Bleaching (BL) | |
| (3) Fixing (Fix) | |
| (4) Stabilizing (ST) | Split into 2 tanks |

III. Example of Processing Time and Processing Temperature

| | Time | Temperature (°C.) |
|---|---|---|
| (1) Color developing (CD) | 1'30" × 2 | 38 ± 0.3 |
| (2) Bleaching process (BL) | 55" | 38 ± 5 |
| (3) Fixing (Fix) | 55" | 38 ± 5 |
| (4) Stabilizing (ST) | 55" × 2 | Room temperature |

The main body frame 10, which constitutes the basic frame body for forming the processor C, is formed of opaque synthetic resin, as subdivided tanks, each having a bottom, as shown in FIG. 2. The space formed on both sides of each tank in the diagram is for installation of driving gears in film conveying system, heater for temperature adjustment, temperature sensor for temperature adjustment, liquid level sensor, etc.

In each processing tank, there is inserted the conveying rack 50 from the top, and its bottom is fixed by engaging with the notch provided in the bottom of each tank. Further, the conveying rack is fixed correctly in the processing tank, by having the rod-like member, provided at the top of the side plate 51 in the conveying rack, engage with the notch at the top of the processing tank.

Size of conveying rack 50 corresponds with the depth of the processing tank. In other words, the length of conveying path is prescribed by the length of processing time, and the length of conveying path is prescribed by the size of conveying rack or the depth of processing tank.

In an automatic developer of the mode shown in diagrams, the color developing tank is divided into No. 1 color developing tank (CD1) and No. 2 color developing tank (CD2), of the same size [this mode includes as an equivalent mode the mode where No. 1 developing tank (CD1) and No. 2 developing tank (CD2) are connected to each other as well as the mode where both tanks (CD1, CD2) have no partitioning wall between them], and the setting is so made that each will have a processing time of one minute and 30 seconds. Bleaching tank (BL) and fixing tank (Fix) are of the same size, each having a processing time of 55 seconds. The stabilizing tank is divided into No. 1 stabilizing tank (ST1) and No. 2 stabilizing tank (ST2), of the same size, and the setting is so made that each will have a processing time of 55 seconds.

The processing liquid agitation means constitutes a key point of the present invention, and it is incorporated into the conveying rack 50, as shown in FIG. 3.

That is, the conveying rack 50 shown in the diagram has the agitation means consisting of a pair of supporting members 51·51, a group of conveying rollers 52, which are placed between those supporting members 51·51, the driving system which drives a group of those conveying rollers 52, the agitation member 53, which is place in the intermediate region between supporting members 51·51, and the driving system 54, which drives the agitation member.

The agitation member 53 consists of the base plate 53A, which engages with the long holes 55 provided in supporting members 51·51, and the vane member 53B, which is fixed to this base plate 53A and protrudes in the side direction.

The driving system 54 in the agitation means is installed on the outer surface of one 51 of supporting members 51.51 in the conveying rack 50, and is connected to the drive transmitting means (not illustrated) installed on the outer surface of the other supporting member 51.

Figure 4:
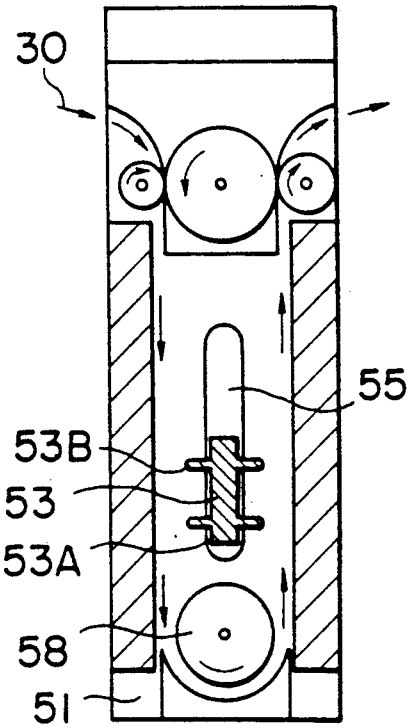

Film 30 enters from the inlet rollers in the conveying rack 50, as shown by the arrow marked in FIG. 3, advances being guided by a group of conveying rollers, is delivered from the outlet rollers, and is transferred to the conveying rack of the next stage. When the midway path of the above is shown by a sectional view, as shown in FIG. 4, film 30 has its edges at both sides engaged with the conveying rollers and is conveyed in a condition of the emulsion surface facing each other, and there is provided the agitation member 53 with the vane positioned in the space on the middle point between the downward film and the upward film. Further, instead of the above arrangement, a power source with the main object of agitation may be installed separately.

Figure 5:
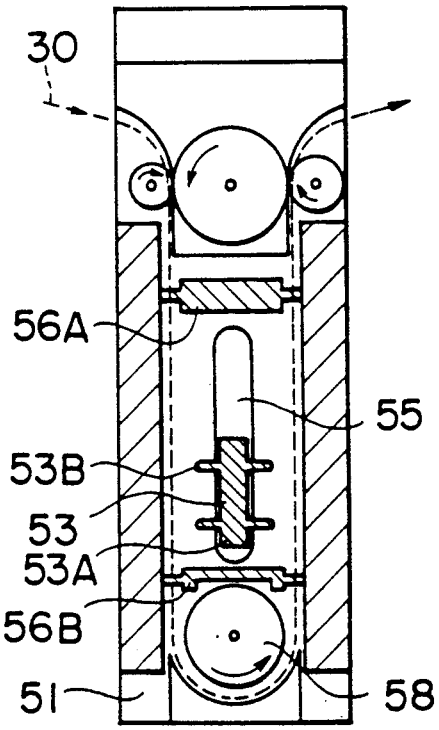
Figure 6:
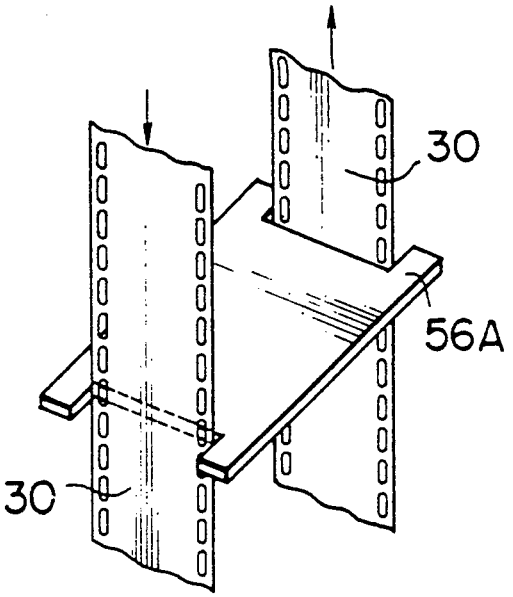
Figure 7:
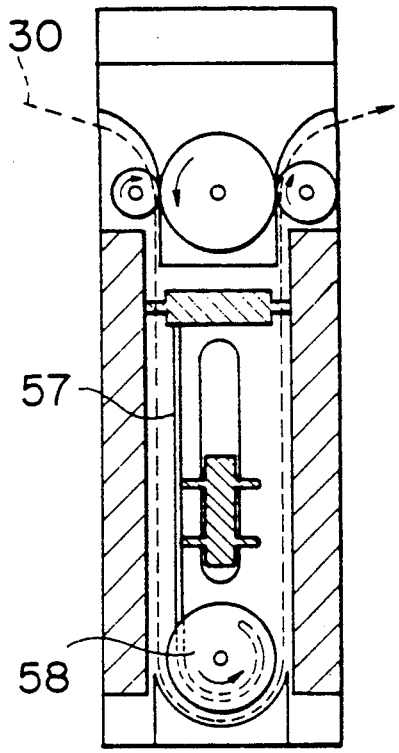
Figure 8:
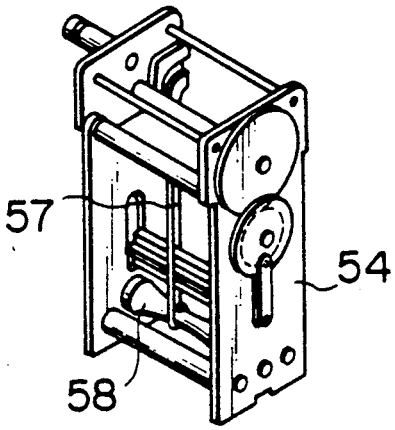
Figure 9:
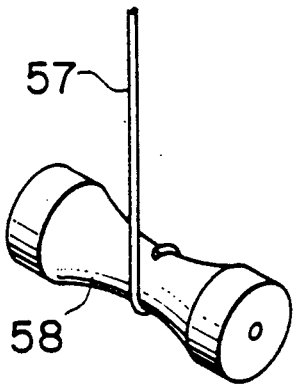
Figure 10:
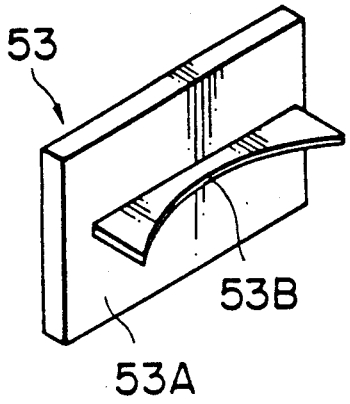
FIG. 10 through FIG. 14 are a perspective view showing another mode of the agitation member, and FIG. 15 through FIG. 17 a schematic sectional view of the same.
Figure 11:
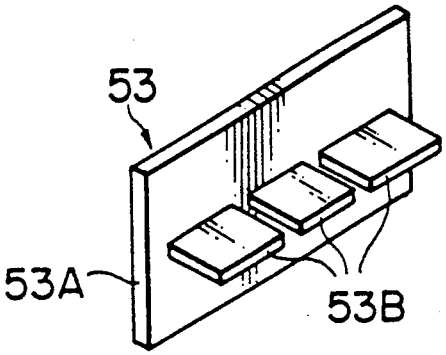
Figure 12:
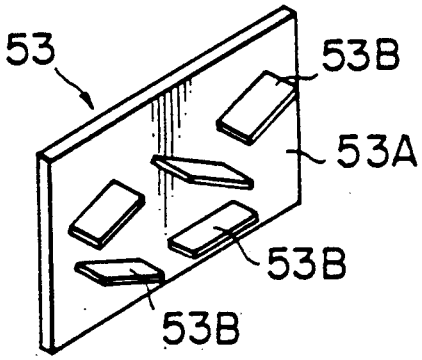

In the case of the conveying method, where film 30 is conveyed by having a leader attached to the tip of film 30 and the film is pulled by the leader which goes ahead, edges at both sides of film 30 need not engage with the conveying rollers. However, in such conveying mode, when there arises a situation where film 30 slackens in the conveying rack 50, there is likelihood that emulsion surface touches the vane 53B in the agitation member 53, thereby damaging the emulsion surface. Therefore, it is desirable to provide a guide plate, etc., as shown in FIG. 6, in a manner shown in FIG. 5, so as to regulate the conveying path favorably. Further, when the vane in the agitation member, which makes a vertical, reciprocating motion in the space formed by the going and returning paths of the film in the conveying rack of the processing tank, is at a distance of 50 mm or more from the film surface, the agitation quality of the processing liquid becomes poor. Furthermore, when the vane comes too close to the emulsion surface of film, there is likelihood of damaging due to contacting with emulsion surface of film. Therefore, for preventing contact with the film, it is possible to have the center portion of the vane cut away so as to be depressed from the surrounding side portions as shown in FIG. 10, thereby having the vane of circular arc form. Alternately, as shown in FIGS. 7, 8 and 9, it is effective to place the contact preventing member 57, etc., which is positioned between the agitation member and the photographic material. Specially, in the film which had been stored in patrone, there will remain the rolling mode. This tends to have its end to roll upward, thereby possibly damaging the photographic material surface on the opposite side. Therefore, attachment of the contact preventing member is effective in preventing film damages. The edge of the vane which makes a reciprocating motion can be fabricated in round form, thereby reducing the possibility of damages even if it touches the film. When the conveying path of film 30 is fixed not to fluctuate, it becomes safe even if the distance between the tip of vane 53B and the film 30 is reduced, since the vertical movement of agitation member 53 is regulated by the long hole 55 provided in the supporting members 51.51. In order to increase the agitation effects of the processing liquid, it is desirable to reduce the distance between the two as much as possible. While this will depend on the processing tank size and speed of the vertical, reciprocating motion, a distance of 50 mm or less is desirable. The form of the vane 53B can be one sheet of board, as shown in FIG. 4. Additionally, many variations are possible by using various materials, such as those, where vane of the agitation member is fabricated into circular arc towards the center (FIG. 10), where one tier of vane is made up of a number of plates (FIG. 11), and where one tier of vane is inclined in different directions, rather than in one direction (FIG. 12). Further, it is possible to generate complex agitation flows of the processing liquid by combination of the above. It is further possible to provide the vane with a multiple number of tiers.

Figure 13:
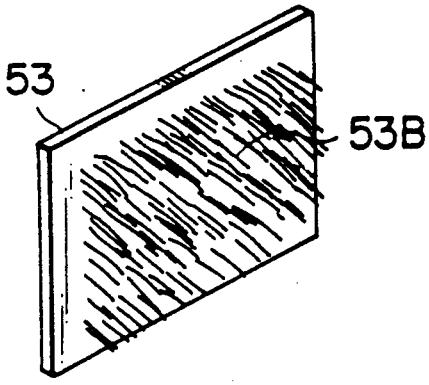
Figure 14:
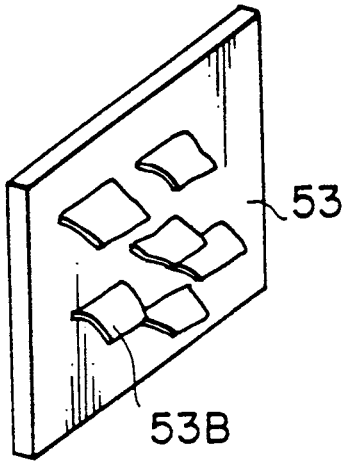

Furthermore, agitation effects can be also expected from the one shown in FIG. 13, where several soft fiber-like materials are protruded toward the photographic material surface, or the one shown in FIG. 14, where cloth-like, soft boards are attached.

In moving the vane 53B as described above in vertical direction, it is simple to utilize a mechanism which converts the rotational motion, which rotates the conveying rollers, into the reciprocating, straight motion as shown in FIG. 3. In the illustrated mechanism, the base plate 53A which fixes the vane 53B is so arranged to move in a straight line along the long hole 55, formed in the center of the supporting member 51. The link 54C, one end of which is fixed to this base plate 53A, has its other end fixed eccentrically to the driven gear 54D, and this driven gear 54D is made to engage with the driving gear 54E, extended from the driving system of the conveying rollers. At this time, there should be provided the so-called "play" or "clearance" in the engaging between the driving gear 54E and the driven gear 54B. Alternately, if a "play" is provided between the driving gear 54E and its axis additionally, when these gears rotate in the direction of pulling the agitation member 53 upward and the fixed point of link 54C exceeds the highest position or the top dead center, the agitation member 53 drops freely due to gravity, to the position where the plays no longer exist, at a speed faster than the rotating speed of gears 54D·54E, due to existence of the "play". Further, at this time, if the conveying force transmitting gear radius is made smaller than the radius of working gear of the cam mechanism, the slippage due to the play in the engaging of the conveying force transmitting gear can increase the slippage in the moving distance of cam mechanism. This means that the moving speed of the agitation member 53 is different between the case of moving upward and the case of moving downward, thereby improving significantly the agitation effects of processing liquid, when compared to the case where both are of the same speed. Of course, the present invention does not intend to exclude the mode in which the speed of upward motion of the agitation member 53 is larger. However, in such a mode the motion mechanism becomes more complex, and additionally there will arise a case where, due to rapid upward motion of the agitation member 54, the processing liquid flows out from the processing tank top by surging, thereby requiring provision of a means of preventing such overflowing. Therefore, it is more advantageous to have a faster motion downward, which permits use of free fall due to gravity.

Further, the motion mechanism of the agitation means shown in FIG. 3 is simply an example. All mechanisms which convert the rotational motion, namely, the driving force for rotating the conveying rollers, into a straight, reciprocating motion of unequal speeds can be applied, unless such mechanisms run counter to the requirements for reduction in size and weight of automatic developers. Included in such mechanisms are those in which the downward movement of the agitation member 53 is not a free falling motion.

Furthermore, the motion frequency of the agitation member 53 can be approximately once is 20 seconds, and this is not necessarily restrictive. In the above embodiment of an automatic developer, since the color developing time is set at 2 times of one minute and 30 seconds and the passing time of subsequent processing tanks at 55 seconds respectively, the agitation frequency will be 4 times in each color developing tank and 2 times in each of the subsequent processing tank.

Naturally, the present invention includes such a mode where the agitation means is installed in at least one tank, for example, only in the color developing tank.

Figure 15:
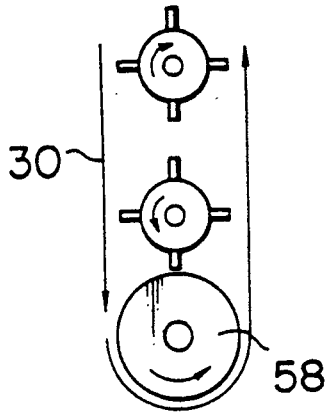
Figure 16:
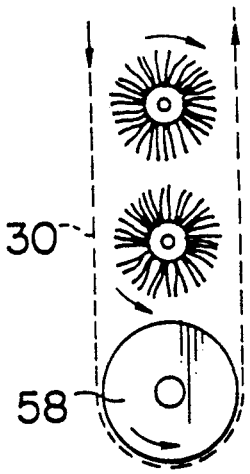
Figure 17:
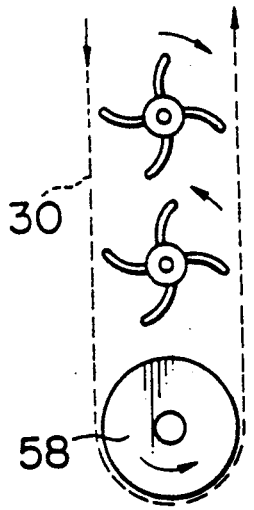

As shown in FIG. 15, FIG. 16 and FIG. 17, it is also possible to agitate the processing liquid by installing rotating agitation rollers having solid vanes, soft fibrous members, or soft vanes in the central space of the conveying rack, which are rotated by the power of conveying and driving system. Rotational direction of such agitation rollers may be in the same direction or in the reverse direction of the film 30 conveying. Further, as shown in diagrams, when a number of agitators are installed, they may rotate in different direction or at different speeds, and such arrangements are included in the modes of the present invention.

Figure 18:
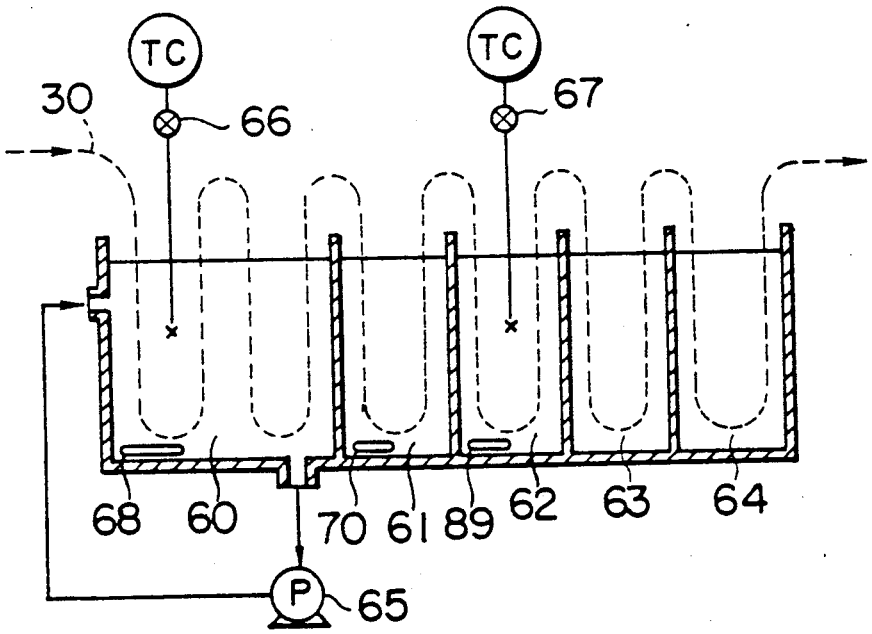
FIG. 18 is a flow diagram around the processor incorporating the present invention.

Developing process of Konica GX-400 was carried out with the processing flow around the processor shown in FIG. 18. With a strict requirement on the temperature precision of within ±0.3° C. in the color developing tank 60, since only the agitation within the rack under the present invention is inadequate, it is necessary to install the circulating pump 65. However, since the temperature precision of the fixing tank 62 is within ±5° C., the agitation within the rack is adequate, thereby not requiring a circulation pump 65. Further, the temperature sensor 66, 67 for measuring temperature in each processing tank needs to be installed in the color developing tank 60 and the fixing tank 62 only. It was found that differences in the bleaching tank 61 are small, even if the power source for the heater 70 was put on/off by measurements in the fixing tank 62.

In order to accomplish reduction in size and weight, constituting the object of the present invention, as stated above, it would be effective to eliminate the circulating pump in tanks other than the color developing tank 60 and also to eliminate the temperature sensor in bleaching tank 61. Further, experiments were made according to this flow diagram using photographic materials listed below, and similar results have been obtained as those with Konica GX-400.

| | |
|---|---|
| 1. Manufactured by Konica Co., Ltd. | GX-II 100 |
| 2. Manufactured by Konica Co., Ltd. | GX-200 |
| 3. Manufactured by Konica Co., Ltd. | GX-3200 |
| 4. Manufactured by Fuji Photo Film Co., Ltd. | Super HR II 100 |
| 5. Manufactured by Fuji Photo Film Co., Ltd. | Super HG 200 |
| 6. Manufactured by Fuji Photo Film Co., Ltd. | Super HG 400 |
| 7. Manufactured by Fuji Photo Film Co., Ltd. | Super HR II 1600 |
| 8. Eastman Kodak Co. Product | Kodak Color Gold 100 |
| 9. Eastman Kodak Co. Product | Kodak Color Gold 200 |
| 10. Eastman Kodak Co. Product | Kodak Color Gold 400 |
| 11. Eastman Kodak Co. Product | Kodak Color Gold 1600 |

In the automatic developer of the present invention, the film is conveyed with respect to each processing tank in such direction that its emulsion surface will mutually face inward. On the other hand, installed in the conveying rack, which is placed in the processing tank, is the agitation member between such emulsion surface, one example of which makes a vertical motion. Moreover, there is provided a processing liquid agitation means, having different speeds in upward and downward motions. Since this agitation means is so constructed to be driven by the power of the film conveying driving force in the conveying rack, it can meet the requirements for reduction in size and weight and improvement in processing performance due to forceful agitation of the processing liquid on the emulsion surface side, thereby solving the problems stated at the beginning.

Additionally, by arranging the conveying path control member in the conveying rack or the contact preventing member with respect to the photographic material in the conveying rack, the photographic material can be conveyed without rubbing damages or pressing damages, thereby solving the problems stated at the beginning.

What is claimed is:

1. An apparatus for developing a photographic material having an emulsion surface thereon, comprising a processing tank for storing processing solution therein;

a conveying means, disposed in said processing tank, for conveying a photographic material downwardly so that a photographic material is introduced in the processing solution and for conveying a photographic material upwardly so that a photographic material is delivered from the processing solution, wherein an emulsion surface of a photographic material being conveyed downwardly is arranged to face an emulsion surface of a photographic material being conveyed upwardly; and an agitation means, disposed between the downwardly conveyed photographic material and the upwardly conveyed photographic material, for agitating the processing solution, said agitation means having an agitation member and moving said agitation member reciprocatively along the conveying direction of the photographic material.

2. The apparatus of claim 1, wherein said agitation member is moved reciprocatively in the upward and downward direction by a driving force derived from said conveying means, thereby agitating the processing solution.

3. The apparatus of claim 1 or 2 wherein between the downwardly conveyed photographic material and the upwardly conveyed photographic material there is provided a contact-preventing means for preventing a contact from taking place between said photographic material and said agitation member.

4. The apparatus of claim 1, wherein said agitation means has a rotatable agitation member and said agitation member is rotated by a driving force derived from said conveying means, thereby agitating the processing solution.

5. The apparatus of claim 2, further comprising a driving means independent of said conveying means, wherein said agitation means is drived by said driving means.

6. The apparatus of claim 2, wherein the moving speed in the upward direction of said agitation member is made to differ from that in the downward direction thereof.

7. The apparatus of claim 2, wherein the moving speed in the downward direction of said agitation member is made faster than that in the upward direction thereof.

8. The apparatus of claim 2, wherein the moving speed in the upward direction of said agitation member is made faster than that in the downward direction thereof.

9. The apparatus of claim 2, wherein said agitation member has a blade member positioned with a distance not larger than 50 mm from the surface of the photographic material.

10. The apparatus of claim 2, wherein a reciprocal movement of said agitation member is carried out at least once per 20 seconds.

11. The apparatus of claim 2, wherein said agitation member has a blade member shaped in a circular arc so that a center portion of said blade member positioned farther than side portion thereof from the surface of the photographic material.

12. The apparatus of claim 2, wherein in said conveying means at a higher position than the top dead center of said agitation member and a lower position than the bottom dead center of said agitation member there are provided a passage-regulating means for preventing the photographic material from moving in a zigzag direction.

13. The apparatus of claim 3, wherein said contact-preventing means is made of a line-shaped material or a bar-shaped material.

14. The apparatus of claim 1, wherein said processing tank has a color development bathe incorporating a circulating pump for circulating a processing solution contained therein.

15. The apparatus of claim 1, wherein said processing tank has a color development tank and a fixing tank, each of which has a thermosensor for temperature control.

16. The apparatus of claim 1, wherein said processing tank has a color development tank and a bleaching-fixing tank, each of which has a thermosensor for temperature control.

17. A developing apparatus in which a photographic material is conveyed by a conveying means in processing solution contained in a processing tank and the processing solution is agitated by an agitation means; comprising an agitation member, and a conversion means for converting a rotating force derived from said conveying means into a reciprocating force to move said agitation member reciprocatively in upward and downward direction, said conversion means including at least a pair of gears wherein a clearance in engagement between said pair of gears is made so larger that the moving speed in the upward direction of said agitation member is proportional to the rotation speed of said gears and the moving speed in the downward direction of said agitation member is made faster than that in the upward direction thereof.

18. The apparatus of claim 17, wherein said agitation member has a blade member positioned with a distance not larger than 50 mm from the surface of the photographic material.

19. The apparatus of claim 17, wherein a reciprocal movement of said agitation member is carried out at least once per 20 seconds.

20. The apparatus of claim 17, wherein said agitation member has a blade member shaped in a circular arc so that a center portion of said blade member positioned farther than side portion thereof from the surface of the photographic material.

21. The apparatus of claim 17, wherein in said conveying means at a higher position than the top dead center of said agitation member and a lower position than the bottom dead center of said agitation member there are provided a passage-regulating means for preventing the photographic material from moving in a zigzag direction.

22. The apparatus of claim 17, wherein between the downwardly conveyed photographic material and the upwardly conveyed photographic material there is provided a contact-preventing means for preventing a contact from taking place between both photographic materials.

* * * * *